United States Patent [19]

Beck

[11] 3,975,261

[45] Aug. 17, 1976

[54] SEQUENTIAL EVENT MEMORY CIRCUIT FOR PROCESS AND QUALITY CONTROL

[75] Inventor: Kenneth H. Beck, Newtown, Pa.

[73] Assignee: Tac Technical Instrument Corporation, Trenton, N.J.

[22] Filed: Feb. 18, 1975

[21] Appl. No.: 550,678

Related U.S. Application Data

[63] Continuation-in-part of Ser. No. 429,861, Jan. 2, 1974, abandoned.

[52] U.S. Cl. ..... 209/74 M; 250/555; 235/92 SH

[51] Int. Cl.[2] ..... B07C 9/00

[58] Field of Search ..... 209/73, 74 R, 74 M, 209/111.5, 111.7; 250/555, 568, 569, 223 R; 198/38, 110; 235/92 SH

[56] References Cited

UNITED STATES PATENTS

| | | | |
|---|---|---|---|
| 3,380,586 | 4/1968 | Frobese et al. | 209/74 R |
| 3,432,032 | 3/1969 | Curphey et al. | 209/74 R X |
| 3,432,035 | 3/1969 | Adams | 209/74 R |
| 3,445,814 | 5/1969 | Spalti | 340/310 R X |
| 3,566,090 | 2/1971 | Johnson | 235/92 SH |
| 3,669,263 | 6/1972 | Babb | 209/111.7 X |
| 3,720,310 | 3/1973 | Lehmann | 209/74 R |
| 3,802,559 | 4/1974 | Luchetti | 209/111.7 |

*Primary Examiner*—Robert B. Reeves
*Assistant Examiner*—Joseph J. Rolla
*Attorney, Agent, or Firm*—Sperry and Zoda

[57] ABSTRACT

An electrical system is disclosed, in which a conventional detector device produces a signal upon its sensing a characteristic or property of a conveyed object at a location upstream, on a conveyor system, from a control location at which the object is to be marked, sorted, segregated, removed, or otherwise acted upon because of said property having been detected. The signal is fed as input to an integrated circuit shift register, in binary form. The shift register is "clocked" by a signal derived either from the power line or other fixed frequency source or from a rotary pulse generator that senses the speed of the conveyor. The register output is connected to a relay amplifier circuit by means of which the original input signal, delayed by the time required to "clock" it through the shift register, is fed to an external sorting, marking or control device disposed at the mentioned, downstream control location.

An "end signal" suppression circuit is described which is used to create a "dead zone" on each side of the detector. This operates to suppress transient, spurious signals produced by the leading and trailing ends of the conveyed material. The positions of the respective dead zone boundaries are adjustable in small increments through the medium of a remote selector switch. The feed speed of the conveyor is sensed through the provision of a rotary pulse generator, which furnishes "clock" pulses to a memory incorporated in the suppression circuitry.

21 Claims, 9 Drawing Figures

RELAY BINARY CIRCUIT

SEQUENTIAL EVENT MEMORY CIRCUIT FOR PROCESS AND QUALITY CONTROL

RELATED APPLICATIONS

The present application is a continuation-in-part of application Ser. No. 429,861, filed Jan. 2, 1974, now abandoned.

BACKGROUND OF THE INVENTION

1. Field of the Invention

In the broadest sense, the invention pertains to the art of sorting, marking, classifying, or otherwise acting upon moving, solid materials pursuant to the detection or sensing of a particular property or properties found therein (e.g., surface defects, blemishes, cracks). In a more particular sense, the invention has reference to a wholly electronic, sequential event memory incorporating integrated shift registers clocked, timed, or synchronized according to sensed variations in the speed of the conveyed material, or to a known power line or other fixed frequency source, and further incorporating "end signal" suppression circuitry to prevent spurious end signals from detracting from the efficiency of the article detection means.

2. Description of the Prior Art

It is known to detect a particular property of a conveyed object at an inspection location upon a conveyor, and thereafter actuate a mechanism at a control station downstream from the inspection point, to mark, remove, or otherwise act upon the material or object having the sensed property.

However, heretofore equipment designed to discharge this function has been, in many cases, at least partly and in many instances completely mechanical, including discs, tapes, balls, pins, or the like. Efforts have been made to avoid such mechanical couplings, through the use of electrical circuitry. Applicant knows of the following patents representative of the prior art:

| | |
|---|---|
| 3,082,871 | Duncan |
| 3,169,424 | Branscom et al |
| 3,259,240 | Schneider |
| 3,310,169 | Forrester |
| 3,352,417 | Cutaia |
| 3,543,929 | Mattia |
| 3,552,560 | Babunovic et al |
| 3,586,168 | Osheff et al |
| 3,616,901 | Groves |
| 3,656,616 | Wallington |
| 3,757,940 | Damm |

These patents fail to provide a compact assemblage of electrical circuit components, capable of being swiftly installed in association with a conventional conveyor system, and so designed as to accomplish in a single structure, all of the following desirable functions:

First, the use of wholly conventional detection mechanisms, whether photoelectric, electromagnetic, sonic, mechanical or the like;

Second, the optional matching of signal delay time to process velocity so as to "track" variable speed of the conveyor or stop-and-go operation thereof, or alternatively, the clocking of the shift register at selectable rates synchronized to a fixed frequency source such as the power line or a crystal oscillator;

Third, the design of the shift register circuitry such as to optionally incorporate therein a quickly adjustable, selected time delay between the input and output of the shift register utilizing one or more decades of digitally selected delay capability;

Fourth, the adaptability of the device for utilization with any conventional marking, sorting, classifying, or segregating mechanism at the control station;

Fifth, circuitry that possesses maximum reliability, freedom from maintenance, and exceptional, pin-point accuracy; and Sixth, "end signal" suppression circuitry that avoids the disadvantages of circuits heretofore devised for the same purpose, such as the requirement for two end sensors, the need to place said sensors in close proximity to the article detector, and the difficulty of physically repositioning the end sensors to accommodate system parameter changes.

SUMMARY OF THE INVENTION

In its most basic aspects, the invention incorporates a conventional detector, designed to sense a particular property of an object conveyed past the detector station. Detection of the specified characteristic creates an input signal, which is fed to an input holding circuit. The signal thereafter appears as input to a shift register, through which it is clocked at a rate determined by clock signals or pulses timed by the output of a rotary pulse generator. When the number of pulses equals the total number of stages or "bit" capacity of the register, the input signal moves from the input to the output terminals thereof.

The pulse generator may be connected to sample the speed of the conveyor, in which event the time required for passage of the input signal through the shift register will vary correspondingly to variations of the conveyor speed. Alternatively, the generator may be connected (where the transport velocity of the moving material is constant) to the power line or other fixed frequency source.

An adjustable digital scaling circuit divides the frequency of the clock timing signal by a selected number set on the decade selector switches.

A clock delay circuit functions in cooperation with the clock generator and a holding circuit for the input signal, to prevent loss of information from input signals shorter than the time occurring between successive clock pulses, and which might randomly fail to coincide with any clock pulse.

The output of the shift register is connected to a relay amplifier circuit by means of which the original input signal, delayed by the time required for its movement through the shift register, is fed to an external sorting, marking, or control device. Further included is an output holding action which may optionally be employed to maintain the output of the relay amplifier for a controllable period following the end of the output signal from the shift register.

The invention further includes means for clearing the sequential event memory to cancel erroneous input information which may inadvertently be fed to the memory circuit during initial adjustment of the overall control system, or due to a malfunction of the detection device from which the input signal is received.

Still further, the invention includes "end signal suppression" circuitry in which a single end sensor senses both the leading and trailing ends of each object conveyed thereby, and acts through a novel circuit to create a "dead zone" within which the article detector is disposed. The dead zone boundaries are individually adjustable in small increments. Close spacing of the material is possible in a modified form of the end signal suppression circuit.

DESCRIPTION OF THE PREFERRED EMBODIMENT

Figure 1:
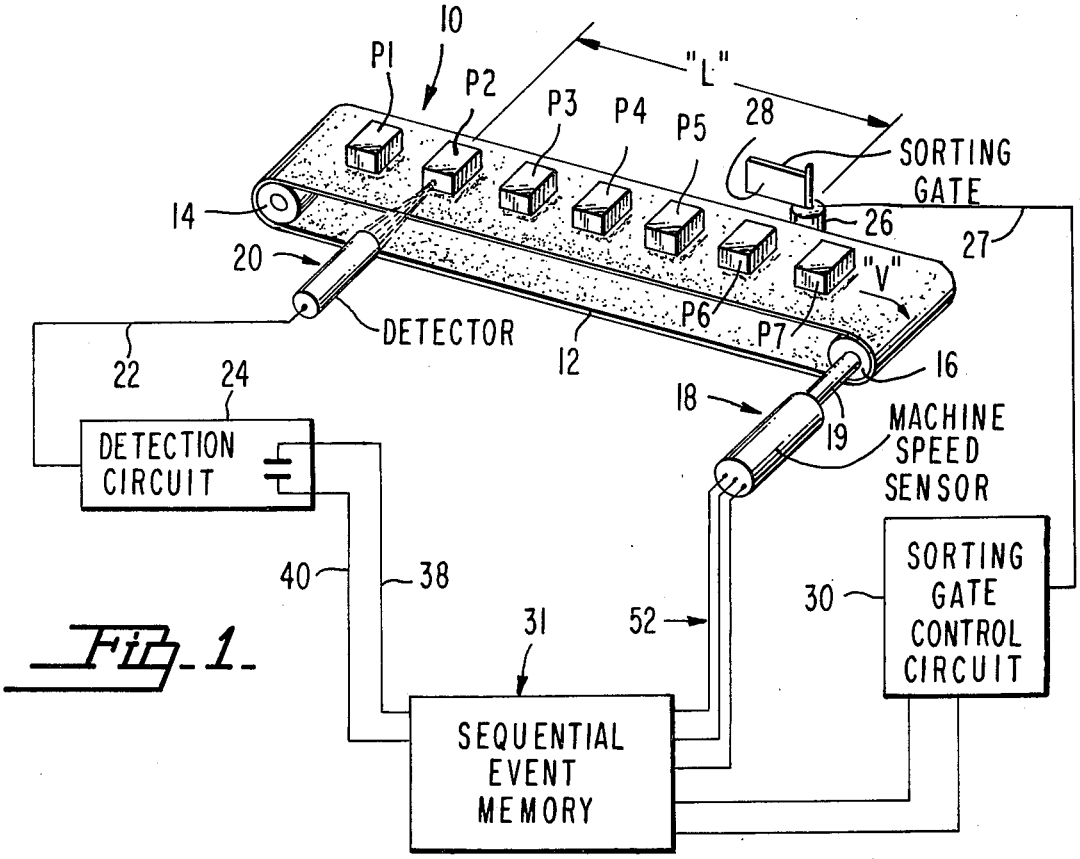
FIG. 1 is a schematic representation of a conveyor system and a sequential event memory device according to the present invention.

Referring to FIG. 1, a typical conveyor structure or article transport mechanism has been generally designated 10, and in the illustrated example includes an endless belt or web 12 trained about rollers 14, 16. Designated at 18 is a machine speed sensor device, of conventional construction. A device of this nature is known per se. Accordingly, no detailed description thereof is necessary. It is sufficient for the purposes of the present application to note that a device of this nature produces a predetermined number of electrical pulses for each revolution of a shaft 19 coupled thereto, and known to rotate at a speed proportional to the transport velocity V for material moving along the conveyor line.

The articles conveyed have been designated P1, P2, P3, P4, P5, P6 and P7 respectively.

Also provided is a conventional detector device 20, which may be sonic, photoelectric, mechanical, or indeed any type of known detector device adapted to sense a particular property or characteristic of a piece conveyed thereby upon belt 12. Such characteristic might be a structural flaw in the piece, a surface irregularity, a potential fatigue point, or the like. Again, for the purposes of the present invention it is sufficient to note that the detector mechanism, upon sensing the predetermined property or characteristic in the conveyed article, activates through a connection 22, a detection circuit 24 that is conventional per se, which circuit is adapted to produce an input signal to the sequential event memory circuitry shown in FIG. 3.

Designated as 26 is a conventional mechanism, whereby a conveyed piece in which the predetermined characteristic has been sensed by detector 20, is acted upon because of its possession of said characteristic. In the illustrated example, the mechanism 26 is a sorting device, including a sorting gate 28. The sorting device 26 has an electrical connection 27 to, and is activated by, a sorting gate control circuit 30 that is conventional per se. The sorting gate control circuit is activated following the passage of a given period of time, responsive to passage of the input signal from the detector through the sequential event memory device constituting the present invention, in a manner to produce an output signal effective to activate the sorting gate control circuit and hence the mechanism 26 when the article to be acted upon has moved from the detection point to the control location or station at which mechanism 26 is located.

Figure 4:
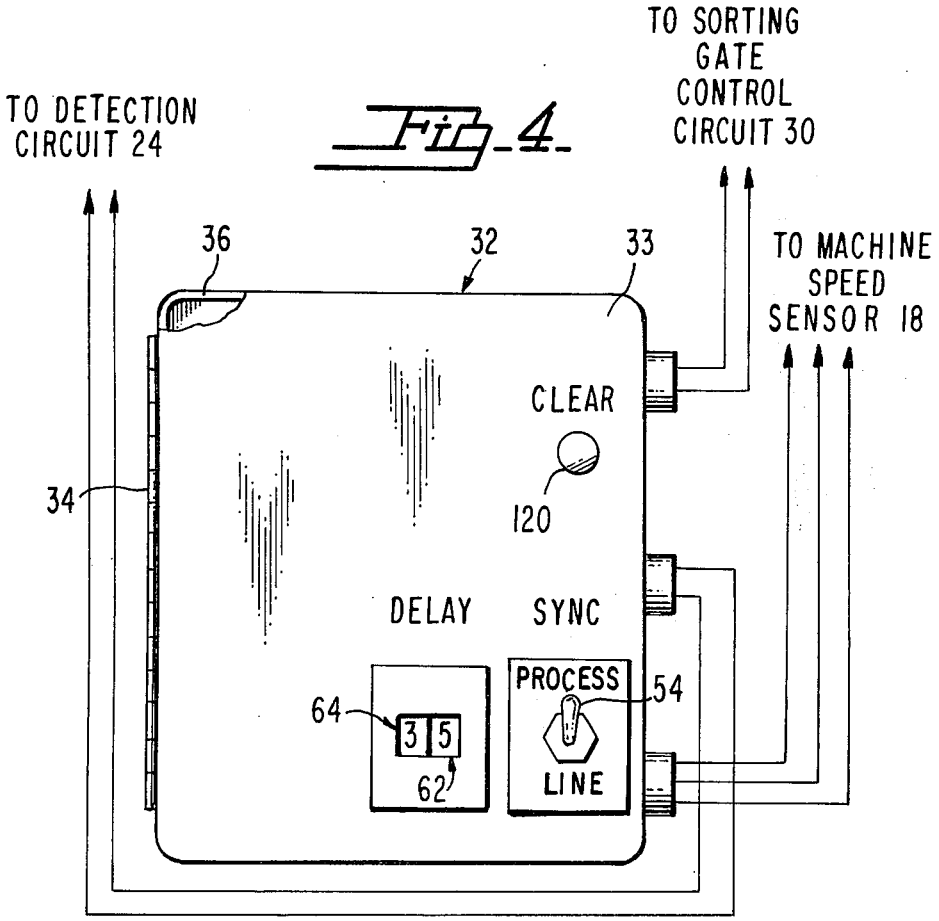
FIG. 4 is an enlarged view of the combined housing and control panel for the circuit components.
Figure 3:
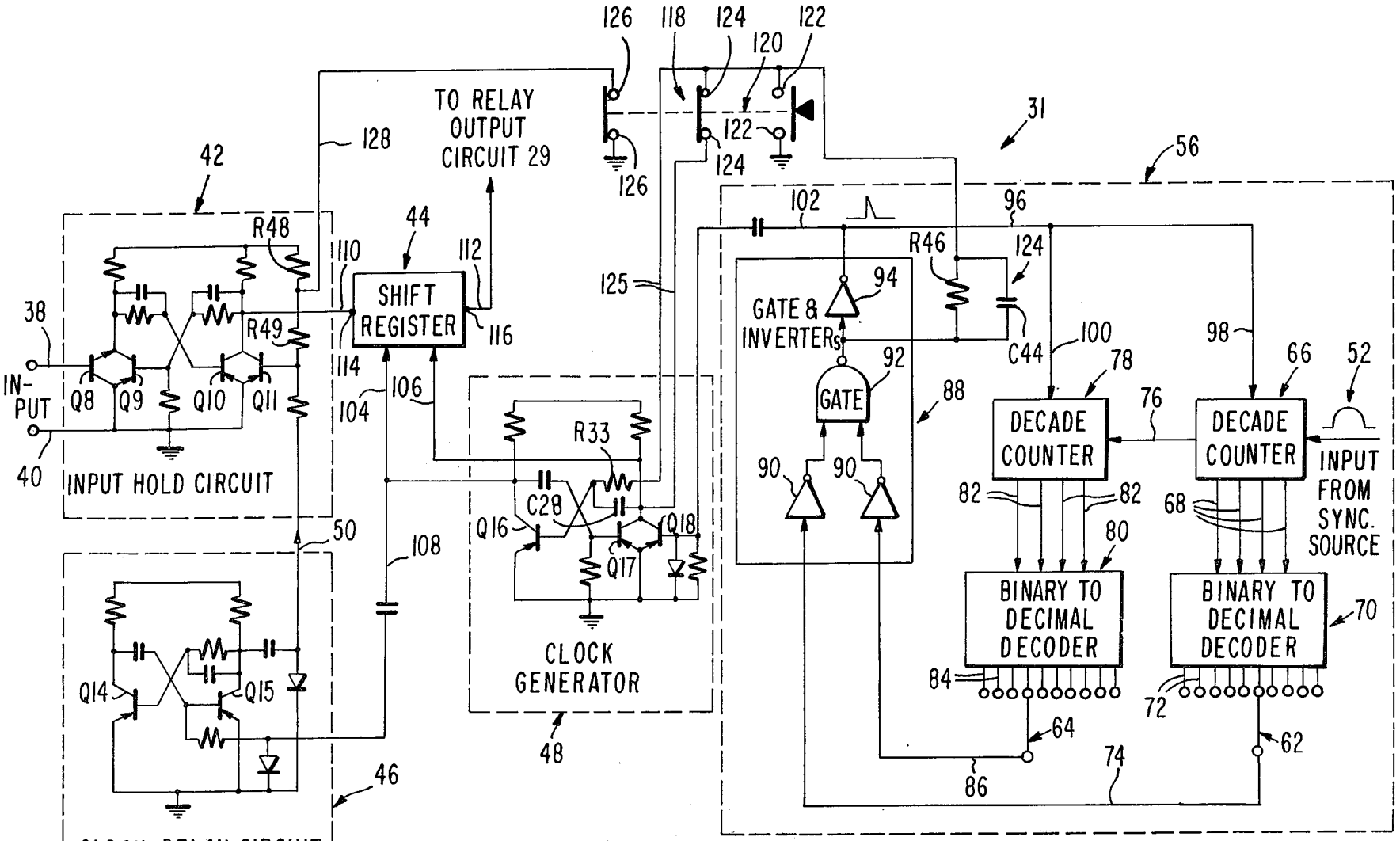
FIG. 3 is a simplified circuit diagram of said memory.

The sequential event memory circuitry associated with the detection mechanism and circuit, the machine speed sensor, and the sorting gate mechanism and circuit, has been generally designated 31 and is illustrated in FIG. 3 schematically. As shown in FIG. 4 the sequential event memory may be housed within a wall-mounted housing generally designated 32, having a door or cover plate 33 hingedly attached as at 34 to the body 36 of the housing. Mounted upon cover plate 33 are various switches and other control devices, accessible to an operator during the normal operation of the equipment.

A signal received from the detector 20 appears as input through leads 38, 40 connected to the input terminals of an input holding circuit 42.

The input holding circuit is a bistable trigger or "flip-flop" which changes state upon the application of an appropriate actuating signal to its input terminals. When in this state, it applies a signal to the input terminals of a shift register 44. This input is maintained, whether or not the initial actuating signal continues, until the flip-flop is reset by a delayed clock signal produced by a clock delay circuit 46. The reset signal is obtained only after a clock pulse has occurred. Accordingly, input information is always transferred through circuit 42 to the shift register regardless of the duration and timing of the initial actuating signal.

Actuating of the input holding circuit may be by means of contact closure of a relay or switch, or alternatively by means of an appropriate voltage level change at the input terminals. Any of these expedients for producing a signal at the input terminals of the circuit 42 is well within the skill of those working in the art, involving no more than creation of the selected type of input signal as a translation of the activation of the detector 20, responsive to its sensing of the predetermined characteristic (for example, a flaw found by ultrasonic inspection), into the desired electrical signal.

Shift register 44 can transfer information from its input terminals to its first and succeeding "memory stages" only at the times when it receives clock pulses from a clock generator circuit generally designated 48. As seen from FIG. 2, the output from the clock generator circuit is both to the clock delay circuit 46 and the shift register 44.

The clock generator circuit and its function will be described in more detail hereinafter. At this particular point, it is sufficient to note that an input signal appearing at the input terminals of the shift register 44 after a clock pulse occurred, but ending before the occurrence of the following clock pulse, would not be transferred into the memory. The input holding circuit 42 is incorporated to prevent the loss of information from input signals that are shorter than the clock period in duration and that might randomly fail to coincide with any clock pulse.

As previously noted herein, input holding circuit 42 is a bistable trigger of "flip-flop" which changes state upon application of an appropriate actuating signal to its input terminals. When its state is so changed, it functions to apply a signal to the input terminals of the shift register. This input is maintained, whether or not the initial actuating signal continues, until such time as the flip-flop is reset by a delayed clock signal produced in clock delay circuit 46 in a manner to be fully described subsequently herein. Since the reset signal is obtained only after a clock pulse has occurred, input information is always transferred to the shift register regardless of the duration and timing of the initial actuating signal.

The actuation of the input holding circuit by means of contact closure of a relay or switch, or alternatively, by means of an appropriate voltage level change at the input terminals, provides flexibility in the choice and design of the device used to introduce input signals to the sequential event memory constituting the present invention.

Referring to FIG. 3, the bistable trigger circuit 42 is comprised of transistors Q9 and Q10 which function in a conventional manner with their associated components to produce the desired action of the input hold circuit. Operation of this circuit is initiated by means of the "pull-down" transistors Q8 and Q11 which receive signals from the memory input terminals connected to leads 38, 40, and from the clock delay circuit 46 through the provision of lead 50.

Keeping in mind at this point that a signal from detector 20 is transmitted to the input holding circuit 42, and through that circuit to the shift register 44, then the signal input to shift register 44 from the input holding circuit 42 will appear as output of the shift register, delayed by the time required to "clock" it through the shift register. This time delay is such as to locate the article in which the particular characteristic was detected, at a new location downstream on the conveyor where it will be positioned for being acted upon by a control device such as shown at 26, 28.

Thus, assuming that a flaw has been detected in article P2 as it moves past detector 20, the signal resulting from such detection is put through circuit 42 and shift register 44, to a relay output circuit 29, thereafter being transmitted to the control device 26 through the control circuit 30. Transmission to the control device 26 will occur after a delay in time sufficient to permit article P2 to move to the control location (occupied by article P6 in FIG. 1).

The invention is concerned with electronic means whereby this time delay between detection of a characteristic of a particular article and action taken with respect to said article because of its possession of the characteristic, is effected. The invention is further concerned with predetermining the time delay according either to the power line or other fixed frequency source, or alternatively, a continuous sensing of the speed of the machine to which the circuitry constituting the present invention is connected.

The control circuit 30, and control device 26, 28, are in and of themselves completely conventional. The relay output circuit 29 is no more than a typical relay amplifier circuit by means of which the original input signal, delayed in the manner discussed is fed to the control circuit 30 for the external sorting, marking, or control device 26 and activates the same. The remainder of this description, accordingly, will be directed primarily to the way in which control of the shift register and input holding circuit are effected to produce the delayed control signal and impart ancillary functions and results.

Accordingly, referring to FIG. 3, 52 represents the input from a synchronizing source. This source as previously indicated, may be a machine speed sensor 18, operating as previously described herein. In this instance, the source of signal 52 is a rotary pulse generator sensing the speed and indeed, complete stoppage and start-up, of conveyor 10. Alternatively, signal 52 may be derived from the power line or other fixed frequency source (typically, the power line may be a 50/60 Hz line; if some other fixed frequency source is used, it could be a conventional fixed frequency oscillator). The possibility of deriving signal 52 from a conventional power line or other fixed frequency source exists if the velocity is constant. If the velocity is subject to variations, then the input 52 would more appropriately be derived from the machine speed sensor or rotary pulse generator 18.

Figure 2:
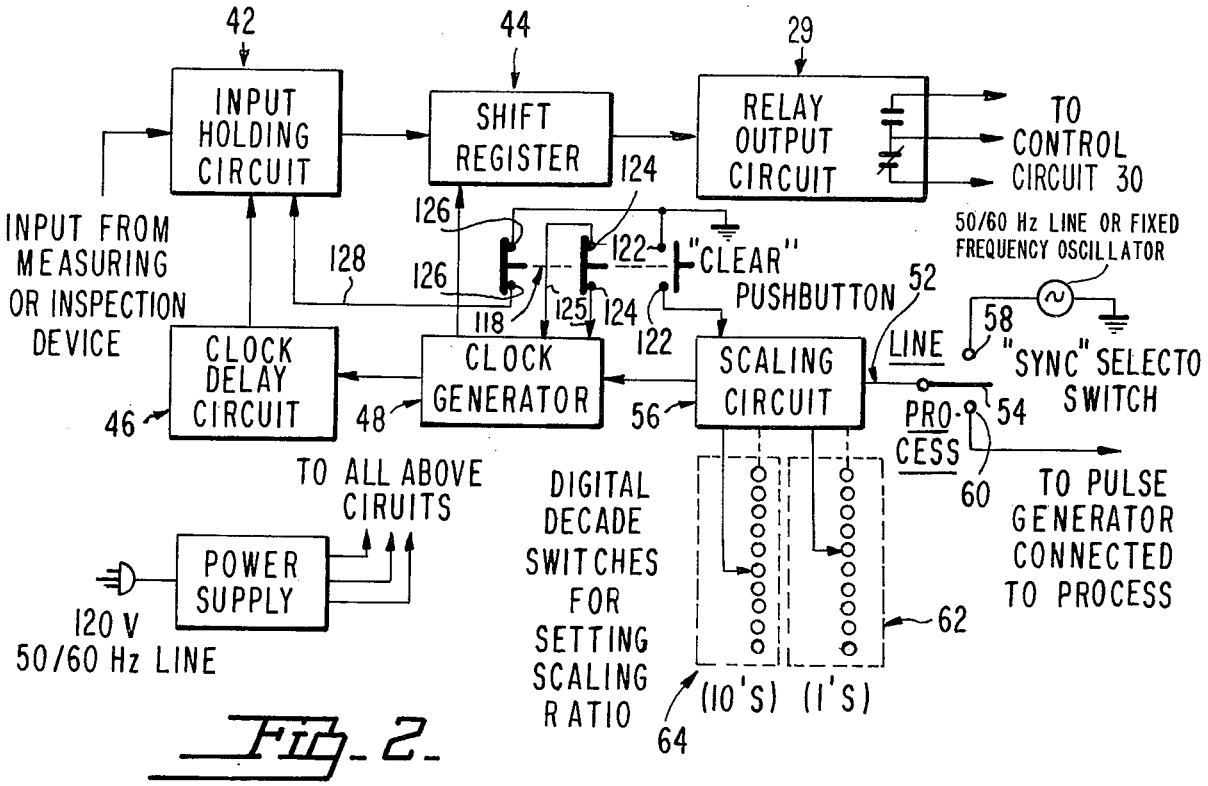
FIG. 2 is a block diagram of the sequential event memory.

The capability of the equipment for convenient, selective switching between the power line frequency, designated "LINE" in FIG. 2, and the machine speed sensor 18 incorporating a rotary pulse generator, designated "PROCESS" in FIG. 2, is established through the provision of a manually operable, SPDT switch 54. In one position, input 52 to a scaling circuit 56 is connected to the terminal 58. In its opposite position, switch 54 connects input 52 to the process terminal 60 connected to the machine speed sensor 18, which is responsive to stopping, start-up, and variations in the speed of the conveyor belt.

Switch 54 is conveniently located for ready access to the user, being mounted upon the cover plate 33 of the housing 32.

The purpose of the scaling circuit 56 is to divide the frequency of the clock timing or synchronizing signal input 52 by a particular, selected number set on the decade selector switches. Circuit 56 is a combination of two or more decade counters, binary-to-decimal decoders, associated decade switches, and a gate-and-inverters circuit. These components, through individually conventional, are combined in a manner to produce certain highly advantageous results.

In the illustrated example, the scaling circuit is illustrated as having two decades 62, 64 ("1's" and "10's" respectively). For many applications, two decades are sufficient. In the illustrated example, thus, the two 10-position switches 62, 64 provide for division of the clock "sync" frequency by any number from 1 to 99.

By way of example, the decade switches are set to divide said frequency by the numeral 35.

Decade switches 62, 64 are conveniently located on the cover plate as shown in FIG. 4.

Referring now to FIG. 3, the signal input 52 from the synchronizing source is fed to the input of an integrated circuit 66. Circuit 66, considered per se, is a conventional decade counter using transistor-transistor logic (TTL). A typical example of such an integrated circuit is that obtainable from Motorola, Inc., as part MC7490P.

Decade counter 66 produces a binary coded decimal (BCD) output on four lines 68 connected to the binary inputs of the integrated circuit 70. This is a conventional BCD-to-decimal decoder obtainable from Motorola, Inc., as part number MC7442P.

The ten dicimal output lines from decoder circuit 70 have been designated 72, and extend to terminals any of which is connectable to lead 47 by means of switch 62. The armature of switch 62 will receive an output signal from the decoder circuit 70 after a number of impulses have been received from the sync source equal to the number of the switch position to which the armature is set (in this case, switch position "5").

In addition to providing a binary input to the decoder 70, decade counter circuit 66 provides a signal through lead 76 to a decade counter circuit 78 identical to the counter 66. This signal to the input of decade counter 78 is provided for every tenth input pulse from the synchronizing source. The binary coded output of counter 78 is connected to integrated circuit 80 through the provision of four output lines 82. The decimal output lines 84 of decoder 80 are connected to terminals selectively connectable to lead 86 through the provision of the switch 64.

Accordingly, if the armature of switch 62 is set on position "5" as shown it will receive an output pulse for every fifth input pulse from the synchronizing source. And, if the armature of switch 64 is set in position "3" as shown in FIG. 3, it will receive an output pulse initiated by the thirtieth input pulse from the synchronizing source. It follows that upon receipt of the 35th input pulse from the synchronizing source, output signals will be present simultaneously on the armatures of switches 62, 64.

As noted from FIG. 3, the armatures of the switches 62, 64 are connected through the provision of the leads 74, 86 respectively to a gate and inverter circuit generally designated 88. This is a conventional integrated circuit, which can be obtained on the open market, and is sold, for example, by Motorola, Inc., as part number MC7400P.

Leads 74, 86 are connected through inverters 90 of circuit 88, to the inputs of a "NAND" gate 92. The output of the gate is connected through another inverter 94 to a reset line 96 connected at 98, 100 to the reset inputs of decade counters 66, 78 respectively.

When a signal appears at the reset input of the decade counters, they return to a "zero count" condition. The result is that after the 35th input pulse from the synchronizing source (assuming the positions of switches 62, 64 to be those in the given example), a pulse will appear on reset line 96, as a result of the simultaneous occurrence of signals on the armatures of switches 62, 64 (and hence in leads 74, 85 extending to the gate and inverters circuit).

If (as is the case) the output of circuit 88 is also used as the synchronizing signal for the clock generator, it will be appreciated that the clock generator will now be operating on a frequency equal to 1/35 that of the synchronizing source. Stated otherwise, the synchronizing source frequency has been "scaled down" by a ratio of 35 to 1.

By proper setting of the decade switches 62, 64, any scaling ratio from 1 to 99 can be obtained. With the addition of a third decade counter, decoder and associated selector switch, the range of the scaler could be extended to 999 to 1.

Reference should now be had to clock generator circuit 48. This has been designed as a monostable multivibrator circuit which will generate clock pulses of the required waveform to cause the shift register 44 to advance binary information through its various stages. The clock rate is determined by the signal fed to the clock generator from the digital scaler previously described herein.

To this end, the output signal from circuit 88 used to reset the decade counters is also connected by lead 102 to the base circuit of a "pull-down" transistor Q18 which initiates one cycle of operation of the mosostable multivibrator comprised of transistors Q16 and Q17 and their associated components.

Simultaneous pulses of opposite polarity are obtained from the collectors Q16 and Q17. The circuit parameters of this multivibrator are adjusted so that the wave forms of these pulses are appropriate to serve as the two-phase clock pulses for the shift register 44. These pulses appear on leads 104, 106.

Shift register 44, is per se, a conventional integrated circuit, capable of purchase on the open market, as for example from Motorola, Inc., as its part number MC1160G.

Referring now to the clock delay circuit 46, this is another monostable multivibrator circuit which provides a signal delayed by a predetermined, short period of time (typically on the order of 30 microseconds) from the initiation of the clock signal. This delayed signal is used in the operation of the input holding circuit.

Thus, the output of clock generator circuit 48 to lead 104 is fed through lead 108 to the base of transistor Q15 of clock delay circuit 46. This triggers one cycle of operation of this multivibrator and results in a negative-going differentiated pulse being fed through connection 50 to the input holding circuit 42 at the completion of the clock delay cycle.

The function of the input holding circuit, touched upon previously herein, may now be readily comprehended in light of the description above, having reference to the input of clock pulses to the shift register 44 from clock generator 48. As previously noted, an input signal is transmitted to the shift register from detector 20, through the input holding circuit 42. This signal appears at the input terminal of shift register 44 through lead 110 extending from the input hold circuit 42. This signal is to be transferred from the input terminal of shift register 44 to which lead 110 is connected, to the first and the succeeding "memory stages" of the shift register, subsequently appearing as an output signal in lead 112, extending to the relay output circuitry 29 which operates the control device 26 through its control circuit 30.

This information can be transferred through the shift register memory stages only at such times as the shift register receives clock pulses from clock generator circuit 48, through leads 104, 106. It may therefore be recalled that an input signal appearing at input terminal 114 of the register after a clock pulse signal has occurred in leads 104, 106, but ceasing before the occurrence of the next following clock pulse in those leads, would not be transferred from input terminal 114 into the shift register memory for transmission to the output 116 of the register. Hence, the input holding circuit 42 is provided to prevent the loss of information from input signals that are shorter than the clock period in duration, and which might randomly fail to coincide with any clock pulse. This is the function of the input holding circuit, and summarizing that function, it may be observed that whenever an actuating signal is applied to the input terminals of circuit 42 through leads 38, 40 extending from the detection circuit, circuit 42 operates to apply a signal to input terminal 114 of the shift register, and functions to maintain that signal whether or not the initial actuating signal continues. This condition of circuit 42 continues until the flip-flop is reset by the delayed clock signal produced in circuit 46 in the manner described above. Since theh reset signal is obtained only after a clock pulse has occurred, input information is always transferred to the shift register regardless of the duration and timing of the initial actuating signal applied through leads 38, 40.

As previously noted, in a preferred embodiment the shift register 44 is a solid state integrated circuit capable of purchase on the open market. Although any type of circuit which can perform a clocked shift register function could be utilized, the high bit density, reliability, and low cost of available integrated circuits make them the preferred choice for utilization in the present invention. A random access memory arranged for serial address is here considered to be essentially a shift register.

The duration of the signal at the output terminal 116 of the shift register is an integral number of clock periods, that depends upon the duration of the input signal to the register appearing at terminal 114. Because of the action of the input holding circuit previously described, the output signal at terminal 116 will always be at least as long as the input signal and may be up to one clock period longer. This is true even for input signals shorter than a clock period. Each of these will produce an output with a duration of one clock period.

With further reference to FIG. 3, the invention incorporates means 118 for canceling or "forgetting" erroneous input information which may inadvertently be fed to the memory circuit during initial adjustment of the overall control system, or possibly due to malfunction of the detection or measuring device 20. To this end, means 118 includes a momentary, manually operable push button switch generally designated 120. Referring to FIG. 4, this is mounted upon the cover plate 33 of the housing, for ready access to the operator.

Push button switch 120 is provided to enable the memory to be cleared in situations such as described above. This is accomplished by having the switch disable the clock generator circuit 48 in such a way as to cause any information in process in the shift register to be lost.

An additional desirable function provided by switch 120 is the resetting of all stages of the clock scaling circuit. Certain adjustments of the clock scaler selector switches can result in a requirement for the decade counter switches to be reset before normal clock operation is established. In practice it has been found that if an adjustment is made in the selector switches 62, 64, this can require the application of a certain number of sync pulses to the input of the scaler circuits in order to achieve the desired reset action. This can result in considerable "dead time" before proper operation is achieved after resetting of the selector switches. To obviate the necessity for this delay, switch 120 includes one set of contacts 122, which are normally open, and are closed by momentary depression of the switch button. In this way, one momentarily connects the output of the gate in circuit 88 to ground, through an appropriate resistor-capacitor network 124 including a resistor R46 and capacitor C44. By so doing, one causes a pulse to appear on reset line 96, extending to the decade counters 66, 78, and this enables normal operation to begin immediately.

Means 118 is also designed to provide for removal of the information stored in the shift register 44 without requiring that a clock sync source be present. This enables the clearing function to be operative even if the clock synchronizing signals are being obtained from a machine speed sensor 18 that happens to be temporarily stopped at the moment. To accomplish this, the clock generator circuit 48 is changed by means of the push buttom switch 120 from its normal function as a monostable multivibrator to an astable multivibrator. This is accomplished by opening a connection of a coupling resistor R33 that normally connects the collector of transistor Q17 to the base of transistor Q16. Upon depression of the push buttom, normally closed contacts 124 of switch 120 are momentarily opened, by opening the connection 125 between the Q17 collector and the Q16 base. In these circumstances, coupling between these points is achieved only through a capacitor C28 which produces self-oscillation of the clock generator and appropriate output wave forms to the lines 104, 106 to effect clearance of the information stored in the shift register.

Means 118 also is operative to disable the input holding circuit 42 to prevent any input signals that might occur during the clearing operation from being transmitted to the shift register and hence to the relay output circuits. This is done by incorporating normally closed contacts 126 in the push button switch. When the switch is operated, the contacts are opened, to remove, through the provision of connecting lead 128, a ground connection from the junction of resistors R48, R49 of the holding circuit.

This allows a negative current from the supply line to be applied to the base of pull-down transistor Q11, causing this transistor and Q10 to conduct. This insures that the input to shift register 44 through lead 110 will be held in the "low" or zero state and will therefore prevent it from receiving any information during the time when the push button is depressed.

It will be understood that although the invention has been applied to a conveyor including an endless belt in which the articles have a straight line motion, this is offered only by way of example. The invention could be applied with equal facility to a rotary indexing table such as is shown by way of example in FIG. 5. In this figure of the drawing, a rotary table 130 is indexed between stations each of which is occupied by a product P1, P2, P3, etc. A detector 20 is provided at one of these stations and can comprise any type of inspection device. Its signal is transmitted through line 132 to detection circuit 24 shown in FIG. 1. The articles are "controlled", as for example rejected, by a control device 26.

The table is rotated with its support standard 134, through the provision of belt 136 trained about pulleys 138, 140. Pulley 140 is rotatable with shaft 142 extending into gear box 144 having an output shaft 146 extending into and driving machine speed sensor 18.

In this application, with proper choice of pulses per revolution ratio of the sensor 18, and the speed ratio of the means 134, 136, 138, 140, 142, 144, 146 used to couple the same to the indexing motion, the setting of the digital decade dial switches 62, 64 can be made as a direct reading of the number of index positions of the table between the "sensing" and "control" stations. This facilitates programming of the control operation.

Reference has been made herein to an end signal suppression function, and it is appropriate at this point to consider the construction and operation of the circuitry embodied in the above-described system to accomplish this function.

When individual pieces of material are moved past a detector capable of sensing or measuring some property of the material, the ends of the pieces may, depending upon the type of detector used, produce large spurious "end signals" from the detector. These end signals often make it difficult to use the detector output in an automatic control system designed to mark, sort or otherwise control the material in accordance with the detected property.

Various means have been employed to "suppress" end signals in such systems. These have generally employed some type of "end sensor" (e.g., photocell, proximity switch, etc.) often placed on both sides of the detector and close to it, and so connected that the output of the detector is disabled when an end is between the sensors. The disadvantages of this method are: (1) the general requirement for two sensors; (2) the need for the sensors to be in close physical proximity to the detector to minimize the length of "uninspected" material at each end of each piece; and (3) the difficulty of physically repositioning the sensors to accommodate system parameter changes such as speed, material size, detector sensitivity, etc.

Incorporation of a memory in an end signal suppression circuit as described below permits the use of a single end sensor which may be located at a considerable distance ahead of the detector. The memory utilizes information from the end sensor to create a "dead zone" on each side of the detector to suppress transients from leading and trailing ends of the material. The position of each boundary of the dead zone is adjustable in small increments by means of a remote selector switch so that no repositioning of the end sensor is required to adapt to new system parameters. The location and size of the dead zone are not affected by speed changes in the material feed mechanism. This is accomplished by sensing the feed speed with a rotary pulse generator which furnishes "clock" pulses to the memory circuit.

Figure 6:
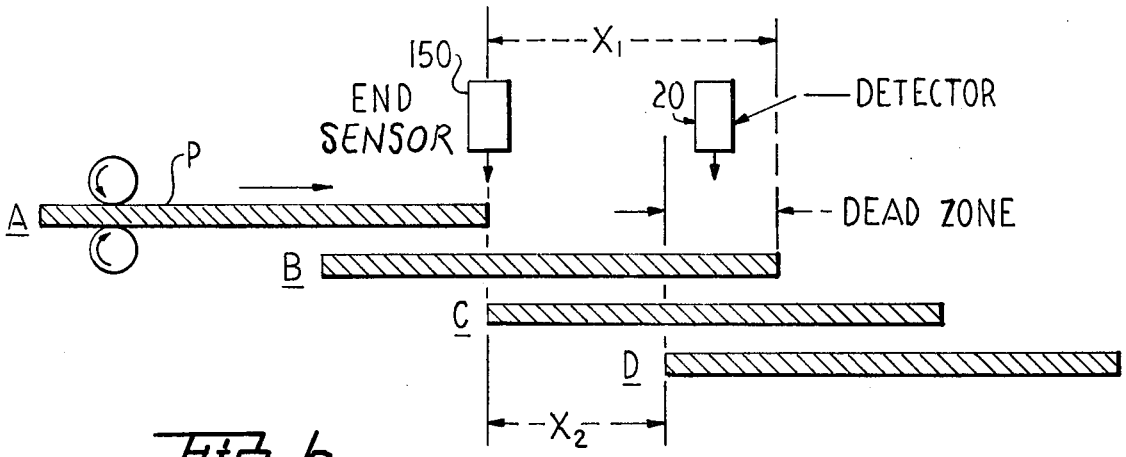
FIG. 6 is a schematic illustration showing the motion of a single piece of material through the end signal suppression area.

To this end, and referring now to FIG. 6, a single piece of material P is illustrated in four important positions, A, B, C, and D as it moves from left to right. These positions are separated vertically in FIG. 6, for purposes of clarity. In actual practice, there would ordinarily be no vertical separation, and piece P would move continuously in a straight line (as shown, for example, in FIG. 1).

At A in FIG. 6 the leading end of the material P has just engaged the end sensor 150. At B, the leading end has passed through the "dead zone" and the detector 20 is about to become energized. At C, the trailing end of the piece reaches the end sensor, and at D the trailing end has reached the near limit of the dead zone after which the detector will become deenergized.

Figure 7:
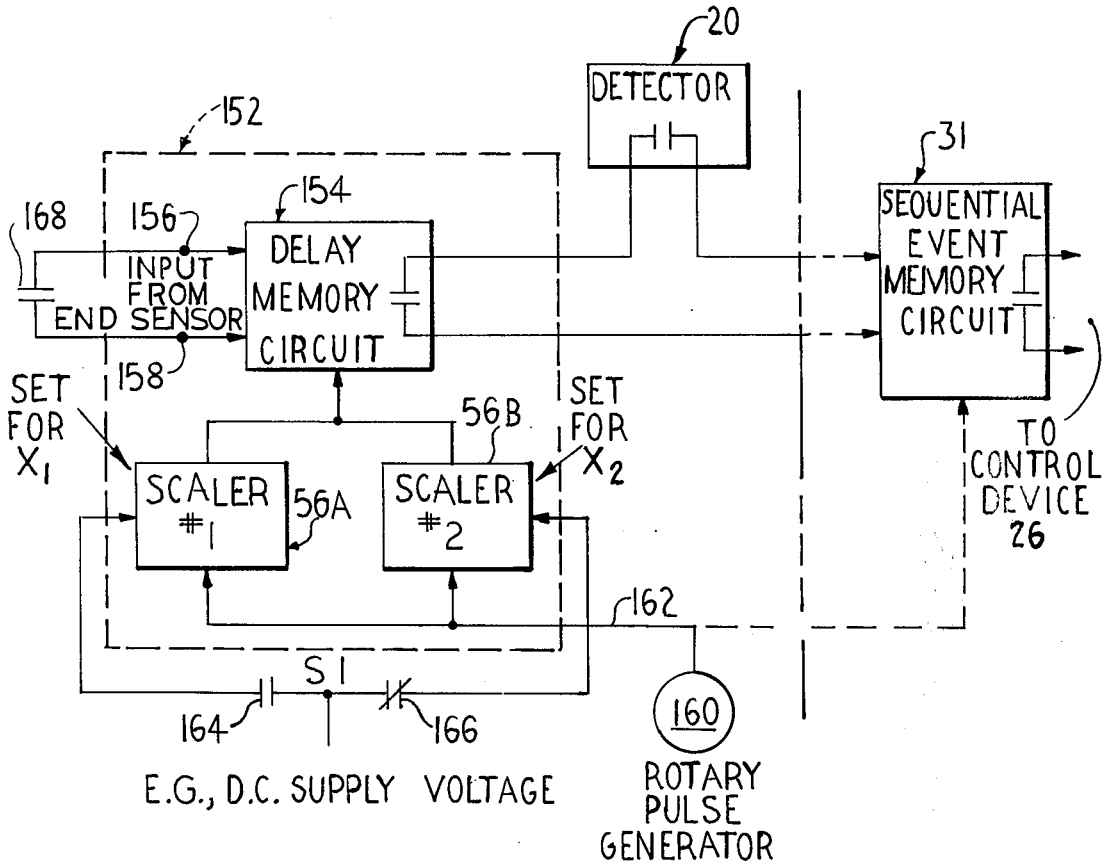
FIG. 7 is a block diagram of the end signal suppression circuit.

Considering this operation in greater detail, in FIG. 7 an end signal suppression circuit 152 essentially comprises circuitry similar to that as seen in FIGS. 2 and 3, the main difference being that in circuit 152 a second digital scaler is used.

Thus, in circuit 152 a delay memory circuit 154 would include the circuitry 29, 42, 44, 46, 48 and 118, all electrically connected and functionally related, and supplied with power, as in FIGS. 2 and 3. It differs from the FIGS. 2 and 3 circuitry, however, in that it includes two scaler circuits 56A ("scaler circuit No. 1") and 56B ("scaler circuit No. 2"), rather than the single scaling circuit 56 of FIGS. 2 and 3. Each of the two scaler circuits 56A, 56B, thus, comprises circuitry such as shown at 56 in FIGS. 2 and 3, wherein the single scaler 56 is there shown as including a pair of decade counters 66, 78 with associated decoders 70, 80 respectively, and a gate-and-inverter circuit 88, all connected and functionally related as in those figures of the drawings to provide the scaling circuit 56.

In FIGS. 2 and 3 the delay memory circuitry is used in cooperation with scaler 56 to delay a signal to a marking, sorting, classifying or other type of control device 26 for the period of time required for passage of a piece P from the detector 20 to said device 26. In FIGS. 6 and 7, however, the delay memory circuitry 154 cooperates with scalers 56A, 56B, to prevent actuation of the detector by spurious, transient end signals produced by the leading and trailing ends of the piece P, as they pass the detector.

As the leading end of a piece P passes end sensor 150 (see position A of piece P) the sensor creates a signal appearing as input to circuit 154, as shown at 156, 158.

Figure 5:
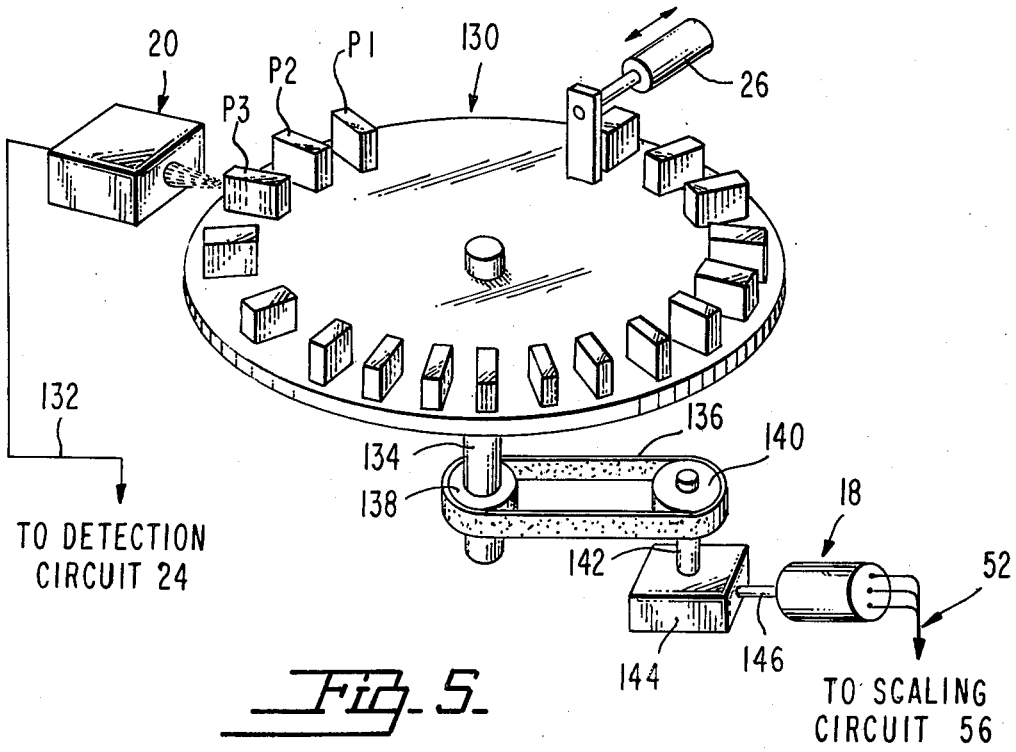
FIG. 5 is a view like FIG. 1, showing the invention applied to a rotary indexing table.

A "clock" signal for memory 154 is obtained from a rotary pulse generator 160, similar to machine speed sensor 18 of FIGS. 1 or 5. This senses the machine speed feed rate, and generates a signal corresponding to that rate. The signal is fed, as schematically shown at 162, to both scalers 56A and 56B (hereinafter scalers Nos. 1 and 2 respectively). One or the other of these scalers is energized depending upon the position of switching contacts 164 and 166. When piece P is under the end sensor 150, contacts 164 are closed, contacts 166 are open, and scaler No. 1 is used. When there is no piece P under the end sensor, switch contacts 164 are open, contacts 166 are closed, and scaler No. 2 is used. The frequency division ratio of the scalers is manually pre-set in the same manner as for scaler 56 previously described herein.

Scaler No. 1 is set to produce a delay such that the output relay of the memory 154 does not close in response to the input signal from the end sensor 150 until the leading end of the material has moved sufficiently past the detector to prevent the generation of a transient end signal (position B in FIG. 6). The leading end of the piece has, at this point, moved a distance $X_1$ from the end sensor as shown in FIG. 6. When the delay memory output relay operates, the detector output is thereby connected to whatever external control circuitry is desired, as for example, the sequential event memory circuit 31 hereinbefore described, and illustrated to good advantage in FIGS. 2 and 3.

Thus, in effect, and referring now to FIG. 3, the end signal suppression circuitry would be interposed between detector 20 and the terminals 38, 40 by means of which the input from the detector is fed to the sequential event memory circuit 31. The result is that the detector is disabled from feeding a signal to the circuitry 31 until the piece P reaches position B of FIG. 6.

When the trailing end of the piece passes the end sensor (position C in FIG. 6), the input signal to the delay memory 154 from the end sensor 150 is removed, scaler No. 1 is deenergized and scaler No. 2 is energized. Scaler No. 2 is set to produce a delay such that the delay memory output relay does not open until the trailing end of the piece has moved a distance $X_2$, as shown at D in FIG. 1, and is as near as it can come to the detector without producing an end transient. When the delay memory output relay circuit opens, the detector output is disconnected from the external control circuit 31.

The leading end of the next piece of material to pass under the end sensor will, of course, start a new cycle of operation.

An inherent feature of the simple system described above is that the spacing between adjacent pieces must be greater than the spacing between the end sensor and the detector for proper operation to be obtained. When this is not the case, another arrangement may be used which employs an additional delay memory and a "toggle binary" switching circuit 172 which may be comprised of relays or solid state elements. This arrangement is illustrated in FIGS. 8 and 9.

Figure 9:
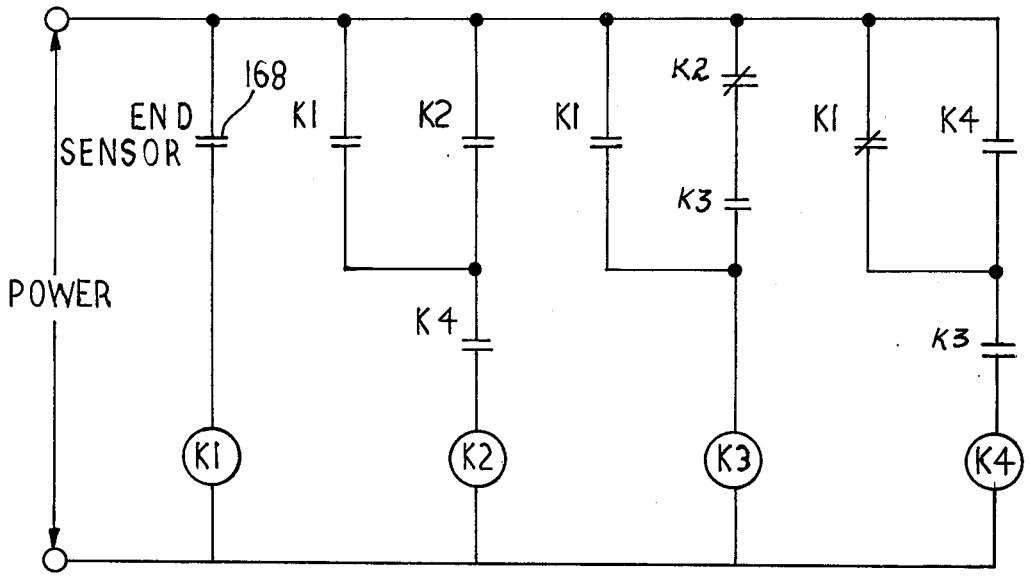
FIG. 9 is a schematic representation of a "toggle binary" switching circuit embodied in the circuitry illustrated in FIG. 8.

The configuration of a suitable relay toggle binary circuit is shown in FIG. 9. Its operation, or that of an equivalent solid state circuit, is as follows: relay K1 operates for the duration of each closure of the contacts 168 (which indicates operation of the end sensor 150), relay K2 operates for the duration of each second operation of the end sensor and relay K4 alternately operates and becomes deenergized upon successive openings of contacts 168.

Figure 8:
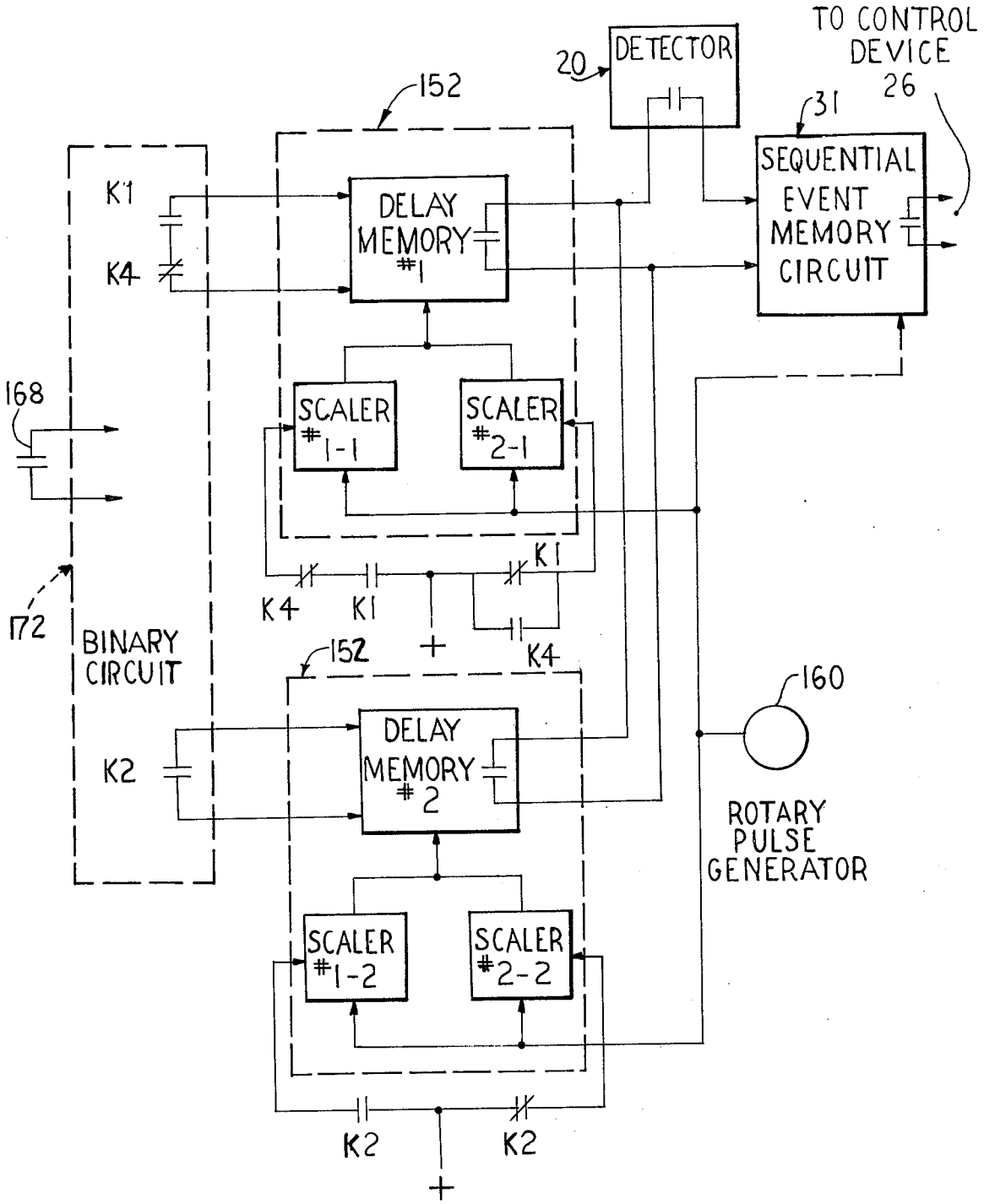
FIG. 8 is a block diagram of a modified form of the end signal suppression circuit designed for use when the conveyed pieces are closely spaced.

Operation of the circuit of FIG. 8 is as follows:

The first end of the first test piece passing the end sensor causes contacts 164 and 168 to close. This puts an input into delay memory No. 1 (DM-1) and energizes scaler No. 1-1. (DM-1 output connects the detector to the external control memory after the leading edge moves through distance $X_1$.)

When the trailing end of the first piece passes the end sensor, contacts 164 and 168 open, removing the input to DM-1 and (since K1 is deactivated and K4 activated) energizing scaler No. 2-1. (DM-1) output opens when the trailing end has moved through distance $X_2$. This disconnects the detector from the external control memory.)

When the leading end of the next piece passes the end sensor, contacts 164 and 168 again close. However, there is no input or switching of scalers to DM-1 since K4 is now activated. This second operation of contacts 168 causes K2 to close, thus applying an input to DM-2 and energizing scaler No. 1-2. (When the leading end of the second piece has traveled distance $X_1$, the output of DM-2 will close, again connecting the detector to the external control memory.)

When the trailing end of the second piece passes the end sensor, contacts 164 and 168 open which deactivates K2 thus removing the input to DM-2 and energizing scaler No. 2-2. The leading end of the next piece has no effect on DM-2 since K2 remains open. (When the trailing end of the second piece travels distance $X_2$, the output of DM-2 opens, disconnecting the detector from the external control memory).

Thus, in effect, the binary circuit alternates two like, parallel circuits 152 each of which is similar to that of FIG. 7, that is, in FIG. 8 delay memory No. 1, and scalers No. 1-1 and No. 2-1 are identical, considered per se, to circuits 154, 56A, and 56B respectively. The same is true of delay memory No. 2 and scalers No. 1-2 and No. 2-2.

Considering a series of pieces P in following order, the passage of the leading and trailing ends of the first, third, fifth and all other odd-numbered pieces would be sensed by the end sensor and the detector dead zone would be produced by the end signal suppression circuitry comprised of delay memory No. 1, scaler No. 1-1 and scaler No. 2-1. Conversely, the passage of the leading and trailing ends of the even-numbered pieces would be sensed by the same end sensor, but the dead zone would be produced by the circuitry constituted by delay memory No. 2, scaler 1-2, and scaler 2-2.

I claim:

1. A system primarily for association with a means for detecting a predetermined characteristic in material being transported by a conveyor, for delaying a pattern of information from the detector, and for repeating that pattern of information at the time when material of the indicated characteristic is at a suitable downstream location on the conveyor to be acted upon by a control device operating in accordance with the delayed information, comprising:

a. a shift register activated by a signal input from the detecting means, said shift register when so activated being adapted for movement of a given input signal pattern therethrough as a function of time at a rate determined by clock pulses separately input to the shift register;

b. a source of synchronizing signals; and c. adjustable decade scaler means interposed between the shift register and said source adapted for input of said clock pulses to the shift register at a rate selectable by user and having a predetermined ratio to said synchronizing signals.

2. A system as in claim 1 in which the source of the synchronizing signals is a power line and the synchronizing signals are at the normal power line frequency.

3. A system as in claim 1 in which said source of synchronizing signals is a sensor means continuously translating variable speeds at which the conveyor is moving into said synchronizing signals, at frequencies having given relationships to said speeds.

4. A system as in claim 1 in which there are alternate, selective sources of said synchronizing signals, one of which produces said signals at fixed frequency and the other at frequencies corresponding to varying speeds at which the conveyor is operated.

5. A system as in claim 1 further including means under the control of a user for clearing, from said shift register, an input signal pattern in passage therethrough.

6. A system as in claim 1 in which the source of the synchronizing signals is a fixed frequency oscillator and the synchronizing signals are at the normal oscillator frequency.

7. A system as in claim 1 in which said means for input of clock pulses to the shift register includes a digital scaling circuit effective for dividing the frequency by a given number selectable by a user whereby said clock pulses are at a frequency at an adjusted ratio selected by the user.

8. A system as in claim 7, further including a clock generator in the form of a monostable multivibrator circuit interposed between the scaling circuit and the shift register for generating clock pulses of a waveform effective to cause movement of the input signal through the shift register.

9. A system as in claim 8 in which the scaling circuit includes at least one decade counter to which the synchronizing signal is fed, said decade counter being effective to translate the input thereto into a binary coded digital output, a decoder of the binary-to-decimal type receiving the output of said decoder including a series of output terminals each representing a decimal, and switch means under the control of a user for connecting a selected one of said terminals to the clock generator, for correspondingly selective scaling of the ratio which the frequency of the signal input to the clock generator bears to the synchronizing signal input to the decade counter.

10. A system as in claim 8 further including an input holding circuit interposed between said sensing means and the shift register and adapted for maintaining a signal at the input of the shift register until a clock pulse is input to said register, said input holding circuit being in the form of a bistable trigger effective to maintain said input signal until reset.

11. A system as in claim 10 further including a clock delay circuit activated by generation of clock pulse by the clock generator circuit, and adapted to reset the trigger when so activated.

12. A system as in claim 1, further including end signal suppression means for preventing the leading and trailing ends of pieces of the conveyed material from producing a spurious signal input from the detecting means to the shift register.

13. A system as in claim 12 wherein said end signal suppression means includes means for sensing the movement of both the leading and trailing ends of a conveyed piece of material past an end sensing point disposed at a location upstream from the detecting means unrelated to any dimension of the conveyed material.

14. A system as in claim 13 wherein said end sensing means comprises a single end sensor adapted to sense both the leading and trailing ends of the material in movement thereby.

15. A system primarily for association with means for detecting a predetermined characteristic in material being transported by a conveyor, for delaying a pattern of information from the detector, and for repeating that pattern of information at the time when material of the indicated characteristic is at a suitable downstream location on the conveyor to be acted upon by a control device operating in accordance with the delay information, comprising:

a. a shift register activated by a signal input from the detecting means, said shift register when so activated being adapted for movement of a given input signal pattern therethrough as a function of time at a rate determined by clock pulses separately input to the shift register;

b. a source of synchronizing signals; and c. means interposed between the shift register and said source adapted for input of said clock pulses to the shift register at a rate selectable by a user and having a predetermined ratio to said synchronizing signals, said means for input of clock pulses to the shift register including a digital scaling circuit effective for dividing the frequency by a given number selectable by a user whereby said clock pulses are at a frequency at an adjusted ratio selected by the user, said system further including a clock generator in the form of a monostable multivibrator circuit interposed between the scaling circuit and the shift register for generating clock pulses of a waveform effective to cause movement of the input signal through the shift register, and switch means under the control of a user for clearing said input signal pattern from the shift register, said switch means having a connection to the clock generator operable to temporarily convert the same from a monostable to an astable multi-vibrator in response to operation of the switch by the user.

16. A system as in claim 15 wherein said source of synchronizing signals is a sensor means responsive to start-up, stopping, and variations in the speed of a conveyor, said operation of the switch means and resultant conversion of the clock generator to an astable multivibrator being effective to clear the shift register at any time including those times when the conveyor is stopped and a synchronizing signal is not being produced by said sensor means.

17. An end signal suppression device for a conveyor system of the type including a detecting means that is sensitive to a predetermined characteristic of the conveyed material and operates to cause material of the indicated characteristic to be acted upon by a control device, comprising:

a. means upstream from the detecting means for sensing movement thereby of the leading and trailing ends of said material and for producing leading and trailing end input signals;

b. means including a delay memory circuit and pair of scaling circuits respectively activated by said leading and trailing end input signals, said last named means producing delayed leading and trailing end output signals, and means activated by the output signals for disabling the detecting means during times when said detecting means may otherwise tend to generate spurious signals resulting from the passage thereby of the leading and trailing ends of the conveyed material.

18. An end signal suppression device as in claim 17 in which the last named means includes like parallel circuits each including a delay memory circuit and a pair of scaling circuits, and means controlling the input to the parallel circuits from said end sensing means, whereby said parallel circuits are respectively operative in respect to two groups of conveyed pieces of material in which the pieces of the first group alternate with the pieces of the second group, thereby providing proper end signal suppression operation for conveyed pieces having a spacing between pieces smaller than the distance between the end sensor and detector.

19. A system primarily for association with a means for detecting a predetermined characteristic in material being transported by a conveyer, for delaying a pattern of information from the detector, and for repeating that pattern of information at the time when material of the indicated characteristic is at a suitable downstream location on the conveyor to be acted upon by a control device operating in accordance with the delayed information, comprising:

a. a shift register activated by a signal input from the detecting means, said shift register when so activated being adapted for movement of a given input signal pattern therethrough as a function of time at a rate determined by clock pulses separately input to the shift register;

b. a source of synchronizing signals; and c. means interposed between the shift register and said source adapted for input of said clock pulses to the shift register at a rate selectable by a user and having a predetermined ratio to said synchronizing signals, said system further including an input holding circuit interposed between the sensing means and the shift register and adapted for maintaining a signal at the input of the shift register until a clock pulse is input thereto, and means under the control of a user for clearing from the shift register an input signal pattern that is in movement therethrough, while simultaneously disabling the input holding circuit to prevent transmission of an input signal to the shift register therefrom during the clearing of the shift register.

20. A system for association with a conveyor for sensing a particular characteristic in a conveyed article, and for acting upon the article at a downstream location comprising:

a. a shift register effective to transfer to its output terminal, for activation of an article control device at the downstream location, a signal received at its input terminal in response to sensing of said characteristic of the article; and b. an adjustable scaling circuit including a decade counter and a binary to decimal decoder having a multi-position switch pre-set by a user for determining the rate at which said signal passes through the shift register.

21. A system primarily for association with a means for detecting a predetermined characteristic in material being transported by a conveyor, for delaying a pattern of information from the detector, and for repeating that pattern of information at the time when material of the indicated characteristic is at a suitable downstream location on the conveyor to be acted upon by a control device operating in accordance with the delayed information, comprising:

a. a shift register activated by a signal input from the detecting means, said shift register when so activated being adapted for movement of a given input signal pattern therethrough as a function of time at a rate determined by clock pulses separately input to the shift register;

b. a source of synchronizing signals; and c. means interposed between the shift register and said source adapted for input of said clock pulses to the shift register at a rate selectable by a user and having a predetermined ratio to said synchronizing signals, said system further including end signal suppression means for preventing the leading and trailing ends of pieces of the conveyed material from producing a spurious signal input from the detecting means to the shift register, said end signal suppression means including an end sensor generating separate signals for the leading and trailing ends, respectively, of each piece of material passing the same, at least one delay memory circuit to which the signals generated by the end signal sensor are input, a pair of frequency dividing scaling circuits each adapted for clocking signal pulses through the delay memory circuit to delay a signal output from the delay memory circuit, means sensitive to the speed of movement of the conveyed material adapted to feed into the scaling circuits a signal the frequency of which corresponds to said speed, and a means controlled by the delayed output signal from the delay memory circuit operative to create a "dead zone" in the area of the detecting means effective to suppress spurious signals that might otherwise be generated by the same on passage of said piece of material thereby.

* * * * *